US008858406B2

(12) United States Patent
Klukas

(10) Patent No.: US 8,858,406 B2
(45) Date of Patent: Oct. 14, 2014

(54) ADJUSTABLE WEIGHT KETTLEBELL

(71) Applicant: Craig Daryl Klukas, Commerce City, CO (US)

(72) Inventor: Craig Daryl Klukas, Commerce City, CO (US)

( * ) Notice: Subject to any disclaimer, the term of this patent is extended or adjusted under 35 U.S.C. 154(b) by 6 days.

(21) Appl. No.: 14/072,594

(22) Filed: Nov. 5, 2013

(65) Prior Publication Data

US 2014/0057764 A1 Feb. 27, 2014

Related U.S. Application Data

(63) Continuation-in-part of application No. 13/412,970, filed on May 14, 2012.

(51) Int. Cl.

| | |
|---|---|
| ***A63B 21/072*** | (2006.01) |
| ***A63B 21/06*** | (2006.01) |
| ***A63B 21/00*** | (2006.01) |
| ***A63B 15/00*** | (2006.01) |

(52) U.S. Cl.

CPC ..... *A63B 15/00* (2013.01); *A63B 21/072* (2013.01); *A63B 21/0726* (2013.01); *A63B 21/0728* (2013.01)

USPC ..... 482/108; 482/93; 482/92

(58) Field of Classification Search

USPC ..... 482/93, 98, 102, 107, 108

See application file for complete search history.

(56) References Cited

U.S. PATENT DOCUMENTS

| | | | | |
|---|---|---|---|---|
| D416,959 | S * | 11/1999 | Tumminia | D21/662 |
| 6,387,022 | B1 * | 5/2002 | Smith | 482/106 |
| 6,689,022 | B1 * | 2/2004 | Emick | 482/93 |
| 7,381,157 | B2 * | 6/2008 | Blateri | 482/50 |
| 7,491,157 | B1 * | 2/2009 | Lin | 482/108 |
| 7,563,208 | B1 * | 7/2009 | Chen | 482/93 |
| 7,731,640 | B1 * | 6/2010 | Chen | 482/93 |
| 8,021,282 | B2 * | 9/2011 | Polevoy et al. | 482/108 |
| D653,715 | S * | 2/2012 | Tumminia | D21/679 |
| 8,608,627 | B2 * | 12/2013 | Ross et al. | 482/93 |
| 2007/0135274 | A1 * | 6/2007 | Blateri | 482/109 |
| 2008/0081744 | A1 * | 4/2008 | Gormley | 482/93 |
| 2009/0062085 | A1 * | 3/2009 | Polevoy et al. | 482/93 |
| 2010/0190619 | A1 * | 7/2010 | Chen | 482/108 |
| 2012/0252641 | A1 * | 10/2012 | Odneal et al. | 482/108 |

* cited by examiner

*Primary Examiner* — Stephen Crow
*Assistant Examiner* — Shila Jalalzadeh Abyane
(74) *Attorney, Agent, or Firm* — Tsz Lung Yeung

(57) ABSTRACT

An exercise apparatus includes a base, a handle, and a connecting device detachably and adjustably connecting the base to the handle to form a weight supporting cavity for supporting a predetermined number of weight plates, wherein a height of the weight supporting cavity is adapted to be adjusted to receive a corresponding number of the weight plates so as to optimally adjust an overall weight of the exercise apparatus.

10 Claims, 4 Drawing Sheets

ADJUSTABLE WEIGHT KETTLEBELL

CROSS REFERENCE TO RELATED APPLICATION

This is a Continuation-In-Part application of a non-provision application having a filing date of May 1, 2012 and an application number of Ser. No. 13/412,970. This application is incorporated by reference herewith.

BACKGROUND OF THE PRESENT INVENTION

1. Field of Invention

The present invention relates to an exercise apparatus, and more particularly to an adjustable weight kettlebell which is capable of allowing a user to optimally adjust a weight thereof by using a predetermined number of existing weight plates.

2. Description of Related Arts

A conventional exercise apparatus, such as a conventional kettlebell, usually has a main body portion and a handle portion integrally extending from the main body portion to form a through opening between the main body portion and the handle portion. Each of the conventional kettlebells is designed to have a predetermined weight so that a user may choose a weight which is the most suitable for him or her.

A typical kettlebell usually has a spherical main body portion and a convexly curved handle portion extending from two sides of the spherical main body portion. The spherical main body portion may be configured by metal material, such as cast iron. The weight of the kettlebell may be attributed to the weight of the material constituting the kettlebell. Thus, the main body portion of a conventional kettlebell is usually configured from a solid material. The heavier the kettlebell, the bigger the size of the kettlebell.

A major disadvantage of conventional kettlebells such as the one described above is that the weight of a particular kettlebell is not adjustable. This is due to the fact that the weight of the conventional kettlebell is attributed by the weight of the main body portion, and there is not any reliable method to alter the pre-existing weight of the main body portion.

SUMMARY OF THE PRESENT INVENTION

An objective of the present invention is to provide an exercise apparatus, such as an adjustable weight kettlebell, which is capable of allowing a user to optimally adjust a weight thereof by using a predetermined number of existing weight plates.

Another objective of the present invention is to provide an exercise apparatus, such as an adjustable weight kettlebell, wherein a weight of the exercise apparatus can be optimally adjusted by conveniently adding or removing weight plates to or from the exercise apparatus.

In one aspect of the present invention, it provides an exercise apparatus for selectively supporting at least one weight plate, comprising:

a base;

a handle; and a connecting device detachably and adjustably connecting the base to the handle to form a weight supporting cavity for supporting a predetermined number of weight plates, wherein a height of the weight supporting cavity is adapted to be adjusted to receive a corresponding number of the weight plates so as to optimally adjust an overall weight of the exercise apparatus.

DETAILED DESCRIPTION OF THE PREFERRED EMBODIMENT

Figure 1A:
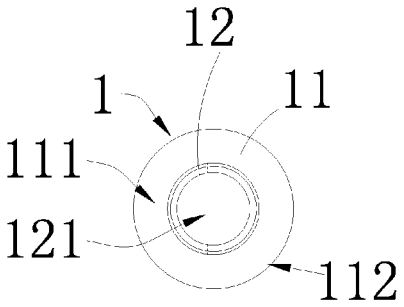
FIG. 1A is a plan view of the base of an exercise apparatus according to a preferred embodiment of the present invention.
Figure 1C:
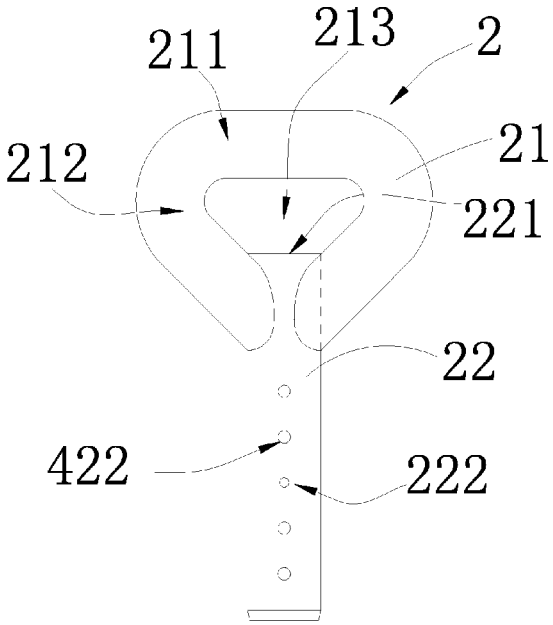
FIG. 1C is a front view of a handle of the exercise apparatus according to the preferred embodiment of the present invention.
Figure 1B:
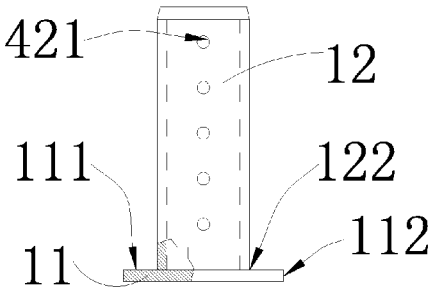
FIG. 1B a front view of the base of the exercise apparatus according to the preferred embodiment of the present invention.
Figure 1D:
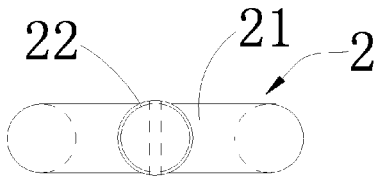
FIG. 1D is a bottom view of the handle of the exercise apparatus according to the preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1A to FIG. 1F, FIG. 2A to FIG. 2C, and FIG. 3 of the drawings, an exercise apparatus, such as an adjustable weight kettlebell, according to a preferred embodiment of the present invention is illustrated. The exercise apparatus is for a user to optimally increasing or decreasing a weight thereof by conveniently adding or removing weight plates. Broadly, the exercise apparatus comprises a base 1, a handle 2, and a connecting device 40.

The connecting device 40 detachably and adjustably connects the base 1 to the handle 2 to form a weight supporting cavity 31 for supporting a predetermined number of weight plates 3, wherein a height of the weight supporting cavity 31 is adapted to be adjusted to receive a corresponding number of the weight plates 3 so as to optimally adjust an overall weight of the exercise apparatus.

This invention is meant to solve the issue of requiring a full complement of conventional kettlebells for a sufficient home gym session. The adjustable nature of the preferred embodiment of the present invention allows for currently produced Olympics sized, or standard sized weight plates to be used as the factor adding or subtracting weight for physical exercise.

The preferred embodiment of the present invention enables a user of currently available weight plates 3 to load weight onto the exercise apparatus, thereby making the exercise apparatus more or less heavy by adding any desirable amount of weight plates 3.

Figure 3:
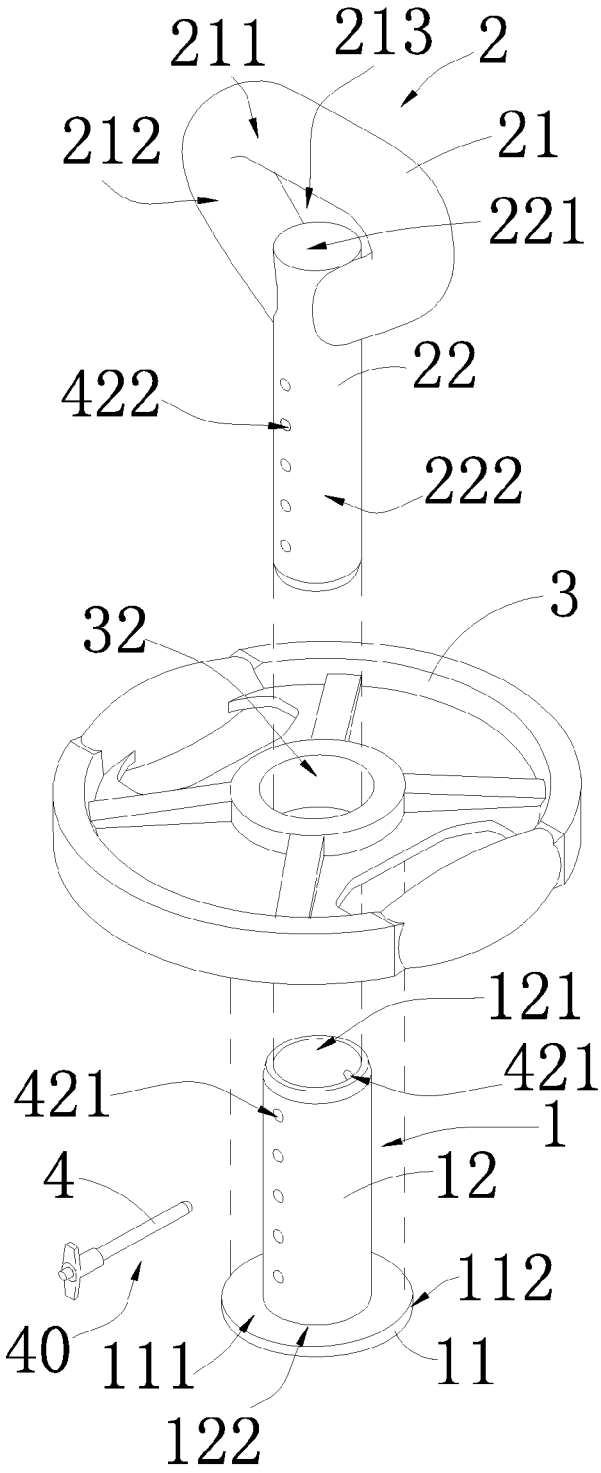
FIG. 3 is a perspective view of the exercise apparatus according to the preferred embodiment of the present invention.

The base 1 comprises a bottom supporting member 11, and a base extension member 12 upwardly extending from the bottom supporting member 11. As shown in FIG. 3 of the drawings, the bottom supporting member 11 has a circular cross section wherein a diameter of the bottom supporting member 11 is substantially larger than a thickness thereof so as to form a panel-like structure of the bottom supporting member 11.

On the other hand, the base extension member 12 has a circular cross section and has a through receiving cavity 121 formed therein so as to define a tubular structure of the base extension member 12. The base extension member 12 is elongated in shape in that an external diameter thereof is substantially smaller than a height of the base extension member 12. Moreover, a longitudinal axis of the base extension member 12 is aligned with a longitudinal axis of the bottom supporting member 11. An external diameter of the base extension member 12 is smaller than a diameter of the bottom supporting member 11 so as to form an annular supporting surface 111 between a peripheral edge 112 of the bottom supporting member 11 and a bottom peripheral edge 122 of the base extension member 12 for supporting a weight plate 3. In this preferred embodiment of the present invention, the base extension member 12 integrally, upwardly and vertically extends from the bottom supporting member 11.

The handle 2 comprises a handle frame 21 and a handle extension member 22 downwardly extending from the handle frame 21 to selectively and adjustably couple to the base extension member 12 through the connecting device 40. The handle frame 21 has a grabbing portion 211 and two inclined portions 212 inclinedly and downwardly extending from two ends of the grabbing portion 211 respectively to form a grabbing cavity 213 as a space between the grabbing portion 211 and the inclined portions 212, wherein a user is able to grab on the grabbing portion 211 for lifting up the exercise apparatus of the present invention.

The handle extension member 22 extends from two inner ends of the two inclined portions 212 of the handle frame 21. The handle extension member 22 is elongated and tubular in structure, and has a circular cross section. It is important to mention that an external diameter of the handle extension member 22 is slightly smaller than an internal diameter of the base extension member 12 so that the handle extension member 22 is capable of being adjustably and slidably received in the base extension member 12. As shown in FIG. 1C, and 2A to FIG. 2C of the drawings, the handle extension member 22 may be divided into an upper portion 221 and a lower portion 222, wherein the lower portion 222 may be completely received in the receiving cavity 121 of the base extension member 12.

Figure 1F:
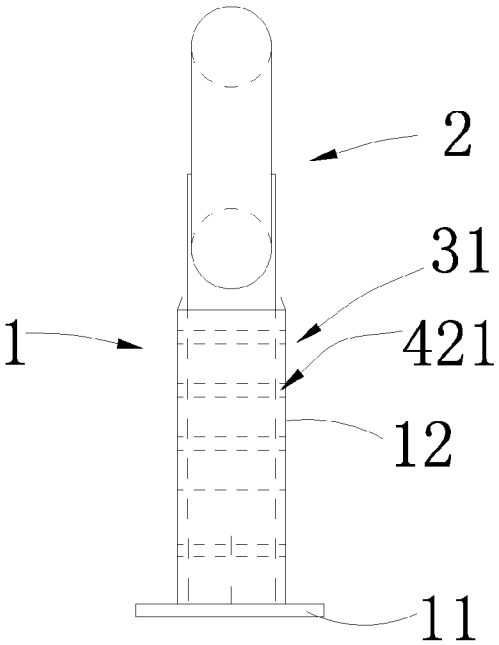
FIG. 1F is a side view of the exercise apparatus according to the preferred embodiment of the present invention, illustrating that the handle is adjustably coupled to the base.
Figure 1E:
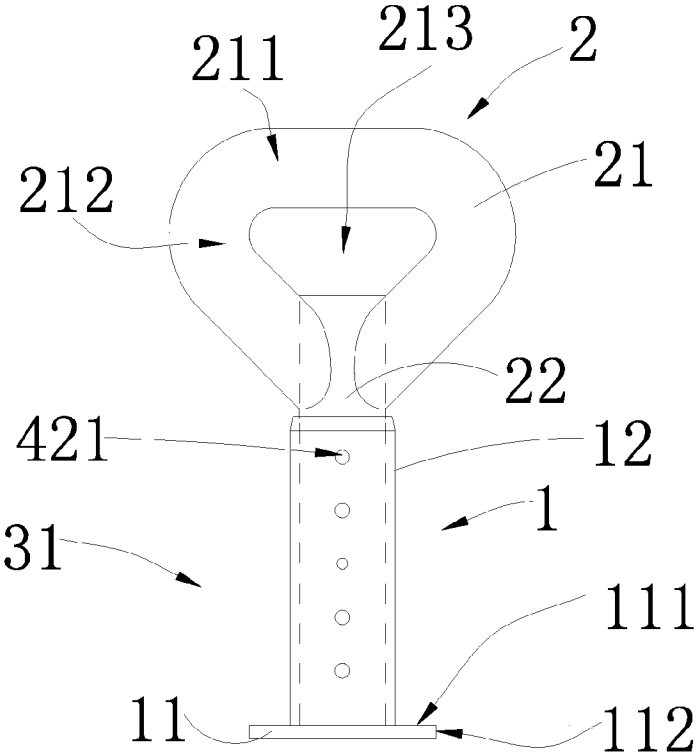
FIG. 1E is a front view of the exercise apparatus according to the preferred embodiment of the present invention, illustrating that the handle is adjustably coupled to the base.
Figure 2C:
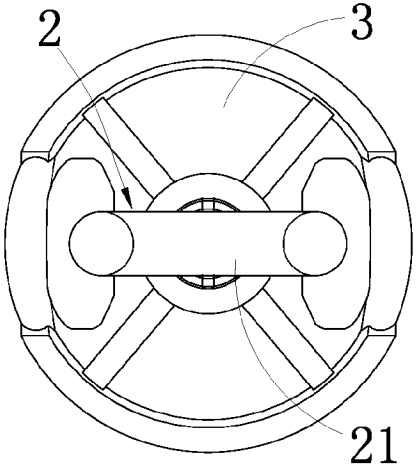
FIG. 2C is a plan view of the exercise apparatus according to the preferred embodiment of the present invention, illustrating that the handle is adjustably coupled to the base which supports a weight plate.
Figure 2B:
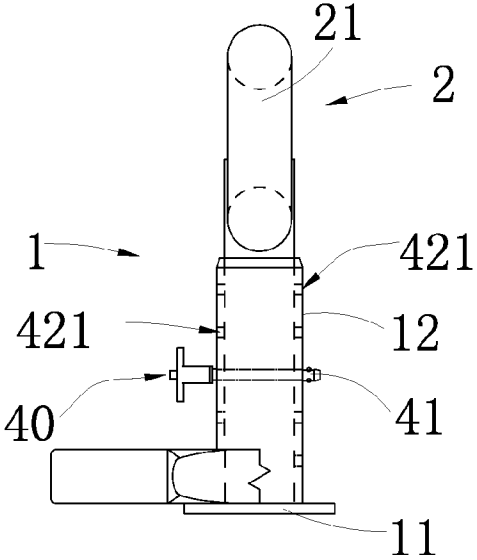
FIG. 2B is a side view of the exercise apparatus according to the preferred embodiment of the present invention, illustrating that the handle is adjustably coupled to the base which supports a weight plate.
Figure 2A:
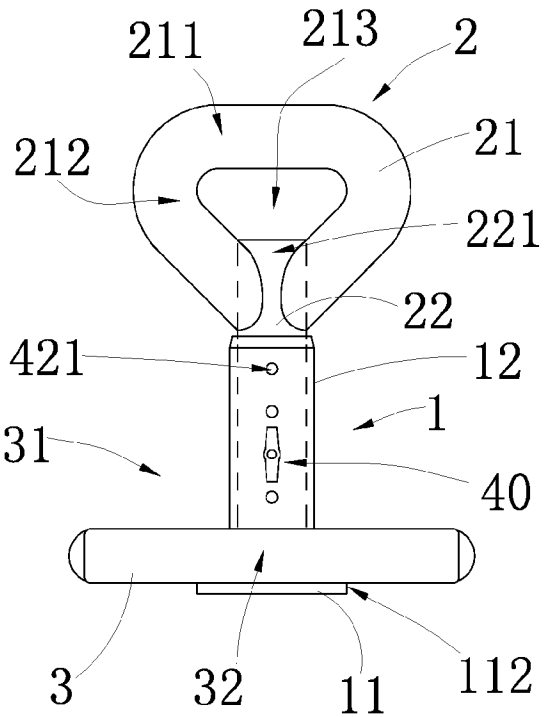
FIG. 2A is a front view of the exercise apparatus according to the preferred embodiment of the present invention, illustrating that the handle is adjustably coupled to the base which supports a weight plate.

The connecting device 40 comprises a release pin 4 and contains a plurality pairs of first adjustment holes 421 spacedly formed on the base extension member 12, and a plurality pairs of second adjustment holes 422 spacedly formed on the lower portion 222 of the handle extension member 22. When the lower portion 222 of the handle extension member 22 is completely received in the base extension member 12, each pair of the first adjustment holes 421 is arranged to align with the corresponding pair of the second adjustment holes 422, as shown in FIG. 1F and FIG. 2B of the drawings.

It is important to mention that the first adjustment holes 421 are distributed along the base extension member 12 in two opposed columns, in such a manner that for each pair of first adjustment holes 421, they are distributed on opposite sides of the base extension member 12 respectively and are horizontally aligned with each other. Similarly, the second adjustment holes 422 are distributed along the lower portion 222 of the handle extension member 22 in two opposed columns, in such a manner that for each pair of second adjustment holes 422, they are distributed on opposite sides of the handle extension member 22 and are horizontally aligned with each other. These structures are illustrated in FIG. 1F and FIG. 2B of the drawings.

When at least one pair of the first adjustment holes 421 on the base extension member 12 aligns with at least one pair of the second adjustment holes 422 on the handle extension member 22, the release pin 4 may penetrate the first adjustment holes 421 and the second adjustment hole 422 so as to couple the base extension member 12 to the handle extension member 22. The space between the bottom supporting member 11 and the handle frame 21 constitutes the weight supporting cavity 31 for accommodating a predetermined or desirable number of weight plates 3. The release pin 4 may be locked so as to lock up the base 1 with the handle 2. When the release pin 4 is pulled out from the first adjustment holes 421 and the second adjustment holes 422, the base 1 and the handle 2 can be detached for insertion, subtraction, or replacement of the weight plates 3. Moreover, each of the weight plates 3 may have a central through slot 32 so that the base extension member 12 may penetrate the central through slots 32 of the weight plates 3.

The operation of the present invention is as follows: to add or subtract weight plates 3, a user may remove the release pin 4 and separate the handle 2 from the base 1. A user may then allowed to put a desirable number of weight plates 3 onto the base 1 as supported by the annular supporting surface 111. The user may then slide the handle extension member 22 into the receiving cavity 121 of the base extension member 121 until at least one pair of first adjustment holes 421 are aligned with a corresponding pair of second adjustment holes 422. Then, the user may penetrate the release pin 4 through the relevant first adjustment holes 421 and the second adjustment holes 422 for coupling the handle 2 with the base 1.

FIG. 2A to FIG. 2C and FIG. 3 illustrate an example of an OLYMPIC style weight plate 3. However, one having ordinary skill in the art would appreciate that any other kinds of weight plates 3 may be utilized. Furthermore, in order to adjust the weight of the exercise apparatus of the present invention, a user may insert different numbers of weight plates 3 onto the base 1.

The present invention, while illustrated and described in terms of a preferred embodiment and several alternatives, is not limited to the particular description contained in this specification. Additional alternative or equivalent components could also be used to practice the present invention.

What is claimed is:

1. An exercise apparatus for supporting at least one weight plate, comprising:

a base which comprises a bottom supporting member, and a base extension member upwardly extending from said bottom supporting member;

a handle which comprises a handle frame and a handle extension member downwardly extending from said handle frame to selectively and adjustably couple to said base extension member; and a connecting device detachably and adjustably connecting said base to said handle to form an unenclosed weight supporting cavity for supporting a predetermined number of weight plates, said connecting device comprising a release pin and containing a plurality pairs of first adjustment holes spacedly formed on said base extension member, and a plurality pairs of second adjustment holes spacedly formed on said lower portion of said handle extension member, said release pin being arranged to penetrate two of said corresponding first adjustment holes and said second adjustment holes to selectively couple said base with said handle, wherein a height of said weight supporting cavity is adapted to be adjusted to receive a corresponding number of said weight plates so as to optimally adjust an overall weight of said exercise apparatus, said plurality pairs of first adjustment holes being distributed along said base extension member in two opposed columns, in such a manner that for each pair of first adjustment holes, said corresponding first adjustment holes are distributed on opposite sides of said base extension member respectively and are horizontally aligned with each other, said plurality pairs of second adjustment holes being distributed along said lower portion of said handle extension member in two opposed columns, in such a manner that for each pair of second adjustment holes, said corresponding second adjustment holes are distributed on opposite sides of said handle extension member and are horizontally aligned with each other, wherein said handle extension member is elongated and tubular in structure, and has a circular cross section, wherein an external diameter of said handle extension member is slightly smaller than an internal diameter of said base extension member so that said handle extension member is adapted to be adjustably and slidably received in said base extension member.

2. The exercise apparatus, as recited in claim 1, wherein an external diameter of said base extension member is smaller than a diameter of said bottom supporting member so as to form an annular supporting surface between a peripheral edge of said bottom supporting member and a bottom peripheral edge of said base extension member.

3. The exercise apparatus, as recited in claim 2, wherein said handle frame has a grabbing portion and two inclined portions inclinedly and downwardly extending from two ends of said grabbing portion respectively to form a grabbing cavity in a space between said grabbing portion and said inclined portions.

4. The exercise apparatus, as recited in claim 3, wherein said bottom supporting member has a circular cross section wherein a diameter of said bottom supporting member is substantially larger than a thickness thereof so as to form a panel-like structure of said bottom supporting member.

5. The exercise apparatus, as recited in claim 3, wherein said base extension member has a circular cross section and has a through receiving cavity formed therein so as to form a tubular structure of said base extension member, wherein an external diameter of said base extension member is substantially smaller than a height thereof so as to form an elongated shape of said base extension member.

6. The exercise apparatus, as recited in claim 1, wherein said handle frame has a grabbing portion and two inclined portions inclinedly and downwardly extending from two ends of said grabbing portion respectively to form a grabbing cavity in a space between said grabbing portion and said inclined portions.

7. The exercise apparatus, as recited in claim 6, wherein said bottom supporting member has a circular cross section wherein a diameter of said bottom supporting member is substantially larger than a thickness thereof so as to form a panel-like structure of said bottom supporting member.

8. The exercise apparatus, as recited in claim 7, wherein said base extension member has a circular cross section and has a through receiving cavity formed therein so as to form a tubular structure of said base extension member, wherein an external diameter of said base extension member is substantially smaller than a height thereof so as to form an elongated shape of said base extension member.

9. The exercise apparatus, as recited in claim 1, wherein said bottom supporting member has a circular cross section wherein a diameter of said bottom supporting member is substantially larger than a thickness thereof so as to form a panel-like structure of said bottom supporting member.

10. The exercise apparatus, as recited in claim 1, wherein said base extension member has a circular cross section and has a through receiving cavity formed therein so as to form a tubular structure of said base extension member, wherein an external diameter of said base extension member is substantially smaller than a height thereof so as to form an elongated shape of said base extension member.

* * * * *